US006728999B2

(12) United States Patent
Murai et al.

(10) Patent No.: US 6,728,999 B2
(45) Date of Patent: May 4, 2004

(54) BUCKLE

(75) Inventors: Ryukichi Murai, Toyama-ken (JP); Ryoji Kawamura, Taipei (TW)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/194,070

(22) Filed: Jul. 15, 2002

(65) Prior Publication Data

US 2003/0014851 A1 Jan. 23, 2003

(30) Foreign Application Priority Data

Jul. 23, 2001 (JP) ..... 2001-221071

(51) Int. Cl.[7] ..... A44B 11/25
(52) U.S. Cl. ..... 24/615; 24/625; 24/614
(58) Field of Search ..... 24/614, 615, 625, 24/629, 633, 265 EC, 265 BC

(56) References Cited

U.S. PATENT DOCUMENTS 3,081,508 A * 3/1963 Johnston ..... 24/625 X
5,146,657 A * 9/1992 Frano ..... 24/265 BC X
5,148,582 A * 9/1992 Dennis, Jr. ..... 24/625
5,471,716 A * 12/1995 Takahashi ..... 24/615
5,566,428 A * 10/1996 Takahashi ..... 24/265 R X
5,604,964 A 2/1997 Aoshima
5,778,498 A * 7/1998 Laks ..... 24/625
5,839,793 A * 11/1998 Merrick et al. ..... 24/615 X

FOREIGN PATENT DOCUMENTS

| | | | |
|---|---|---|---|
| DE | 88 14 275 | 12/1998 | |
| EP | 0 629 362 | 12/1994 | |
| EP | 1 186 251 | 3/2002 | |
| JP | 08--154711 | * 8/1996 | ..... A44B/11/25 |

* cited by examiner

*Primary Examiner*—Robert J. Sandy
(74) *Attorney, Agent, or Firm*—FInnegan, Henderson, Farabow, Garrett & Dunner, L.L.P.

(57) ABSTRACT

In a buckle of a type in which an insertion body of a male member is inserted into a housing of a female member, the male member is comprised of the insertion body and a belt attaching frame, the insertion body and the belt attaching frame being formed separately while a base end of the insertion body and the belt attaching frame are linked with each other so as to be freely rotatable, and the female member is comprised of the housing and a belt attaching frame, the housing and the belt attaching frame being formed separately while a front end of the housing and the belt attaching frame are linked with each other so as to be freely rotatable. Consequently, the buckle can readily fit a configuration of a surface of a product to be used, particularly a curved state thereof, thereby achieving a stable tightening.

7 Claims, 19 Drawing Sheets

BUCKLE

BACKGROUND OF THE INVENTION

1. Field of the Invention

The present invention relates to an engaging/disengaging type buckle or fastening device in which an insertion body of a male member is inserted into a housing of a female member. More particularly, it relates to a buckle or fastening device, which is suitable for use, when the surface of clothes, bag, carrier bag, package and the like is curved.

2. Prior Art

A buckle or a fastening device of every kind in which an insertion body of a male member is inserted into a housing of a female member has been widely used to meet the users' demand. For example, Japanese Patent Application Laid-Open No. 7-210 discloses a buckle that can readily fit the surface configuration of a product to be used. This buckle is, for example, provided with a male member 2' which is comprised of a linking body 51' and an engaging body 5' as shown in FIG. 23. The linking body 51' has a belt attaching member 7', a pair of side frames 34' and a base member 25' which is rotatably pivoted between the pair of the side frames 34'. The engaging body 5' has an engaging portion 29' and a connecting portion 50' which is rotatably pivoted at the base member 25'.

The female member 1' is comprised of a belt attaching portion 38' and a housing 4'. The housing 4' has an engaged portion 15' with which the engaging portion 29' engages so as to be rotatable. When tension is applied while the male member 2' and female member 1' are connected with each other, the other members including a belt, which are attached to the male member 2' and the female member 1', can rotate around the axes of three directions.

Japanese Patent Application Laid-Open No. 8-154711 discloses a buckle of such a type that tensile load applied to the male member 2" and the female member 1" becomes compression load which engages both the members. This buckle, as shown in FIG. 24, comprises a female member 1" which has a housing 4" at one end and a first attaching portion 52" at the other end for attaching the belt B", and an insertion body 5" which has an insertion leg portion 26" at one end, which can be inserted into the housing 4" detachably and a second attaching portion 52" at the other end for attaching the belt B". The second attaching portion 52" is provided on an L-shaped rotary attaching member 54" separated from the insertion body 5".

An end portion of the L-shaped rotary attaching member 54" is attached to the insertion body 5" so as to be rotatable. After the insertion body 5" is inserted into and engaged with the housing 4", the male member 2" and the rotary attaching member 54" are rotated relatively to each other, so that the second attaching portion 52" opposes the guide portion 55" across the housing 4". Consequently, tensile load applied to the female member 1" and the male member 2" via the rotary attaching member 54" becomes compression load which engages both the members.

In the buckle as disclosed in said Japanese Patent Application Laid-Open No. 7-210, the male member 2' can be changed in three directions with respect to the female member 1', so that the belt attaching member 7' existing at a front end of the male member 2' can be changed freely. However, because the belt attached to the housing 4' cannot be varied freely with respect to the housing 4', this is lack of adaptability to the surface configuration of a product to be used.

In the buckle disclosed in said Japanese Patent Application Laid-Open No. 8-154711, the L-shaped rotary attaching member 54" having the belt attaching portion is attached to the end portion of the insertion body 5" of the male member 2" so as to be rotatable. However, the buckle changes tensile load applied to itself to compression load by a special use condition of the buckle, for example by rotating the male member 2" and the rotary attaching member 54" relatively to each other after the insertion leg portion 26" of the male member 2" is inserted into and engaged with the housing 4" of the female member 1". Thus, the pulling direction of the belt B" with respect to the buckle cannot be changed freely.

SUMMARY OF INVENTION

The present invention has been achieved in consideration of the above-described problems. The present invention aims at providing a buckle or a fastening device of an insertion type of a male member with a female member, in which a belt linked with the buckle or the fastening device is capable of rotating freely with respect to the buckle or the fastening device in an uneven manner in a horizontal surface, which is easy to be adapted to a curve on the surface of a product for which the buckle or the fastening device is used, so that the fastening operation of the belt can be carried out easily and securely.

Further, in the buckle or the fastening device of the insertion type in which the belt attaching portion is capable of rotating freely, wherein the belt can be disposed on the female member and the male member with a simple mechanism and structure.

Furthermore, the buckle or the fastening device of the insertion type can be formed in such a type that the belt disposed in the female member or the male member can be adjusted in length with respect to only one of the members, or is formed in such a type that both of the members them fix the belt. Alternatively, the buckle may be formed in a type that the belt can be adjusted in length with respect to the both members. Consequently, the present invention aims at providing a buckle or fastening device of the insertion type which is adaptable for various kinds of products, and which has such a shape that is prevented from being raised when the belt is tightened so as to achieve stable belt tightening.

To achieve the above-described object, according to the present invention, there is provided a buckle or a fastening device of a type in which an insertion body of a male member is inserted into a housing of a female member, wherein the male member is comprised of the insertion body and a belt attaching frame, the insertion body and the belt attaching frame being formed separately while a base end of the insertion body and the belt attaching frame are linked with each other so as to be freely rotatable, and the female member is comprised of the housing and a belt attaching frame, the housing and the belt attaching frame being formed separately while a front end of the housing and the belt attaching frame are linked with each other so as to be freely rotatable. For convenience of description, the term "buckle" referred to herein after includes a fastening device.

Further, it is preferable that the male member has a pair of protruded pieces provided at both sides of a base member of the insertion body in a direction opposite to insertion leg portions protruded from the base member, shafts, which can hold the belt attaching frame such that it is freely movable, are provided so as to protrude laterally on outer faces of the protruded pieces, and shaft holes, which allow the shafts to be pivotally engaged therein so as to be freely movable, are provided at front ends of frame members of both sides of the belt attaching frame having a U-shape.

Furthermore, it is preferable that the female member has a pair of protruded pieces protruded outward at both sides of a front end of the housing opposite to an insertion opening thereof, shafts, which are capable of holding the belt attaching frame so as to be freely movable, are protruded laterally on outer faces of the protruded pieces, and shaft holes, which the shafts are capable of pivotally engaging so as to be freely movable, are provided at front ends of frame members of both sides of the belt attaching frame, which has a U shape.

Still further, it is preferable that the insertion body and the belt attaching frame, which compose the male member, and the housing and the belt attaching frame, which compose the female member, are formed by integral molding or extrusion using thermoplastic resin in such a state that the insertion body and belt attaching frame, and the housing and belt attaching frame are linked with each other, respectively.

Still further, it is preferable that one of the belt attaching frames disposed in the male member and the female member has a belt adjusting mechanism comprised of a hooking member for hooking a belt and a holding member for holding a belt, which are provided in parallel to each other, while the other one of the attaching frames has an attaching member for attaching a belt.

Alternatively, it is preferable that both the belt attaching frames disposed in the male member and the female member have only attaching members for attaching belts.

Still alternatively, it is preferable that both the belt attaching frames disposed in the male member and the female member have belt adjusting mechanisms each comprised of a hooking member for hooking a belt and a holding member for holding a belt, which are provided in parallel to each other.

Further, it is preferable that the hooking member for hooking the member and the holding member for holding the belt, which are disposed on the belt attaching frames provided on the female member and the male member, are disposed between right/left frame members such that the hooking member and the holding member are deflected upward of a center line of tensile load of the belt while a holding action point exists on the tensile line.

Furthermore, it is preferable that at the belt attaching frames provided in the female member and the male member, a blocking member for blocking a rise of the belt attaching frames when the belt is tightened is provided between the right/left frame members of the belt attaching frames on an outer side of the hooking member for hooking the belt and the holding member for holding the belt.

EMBODIMENTS OF INVENTION

Hereinafter embodiments of a buckle of the present invention will be described in detail with reference to the accompanying drawings.

Figure 1:
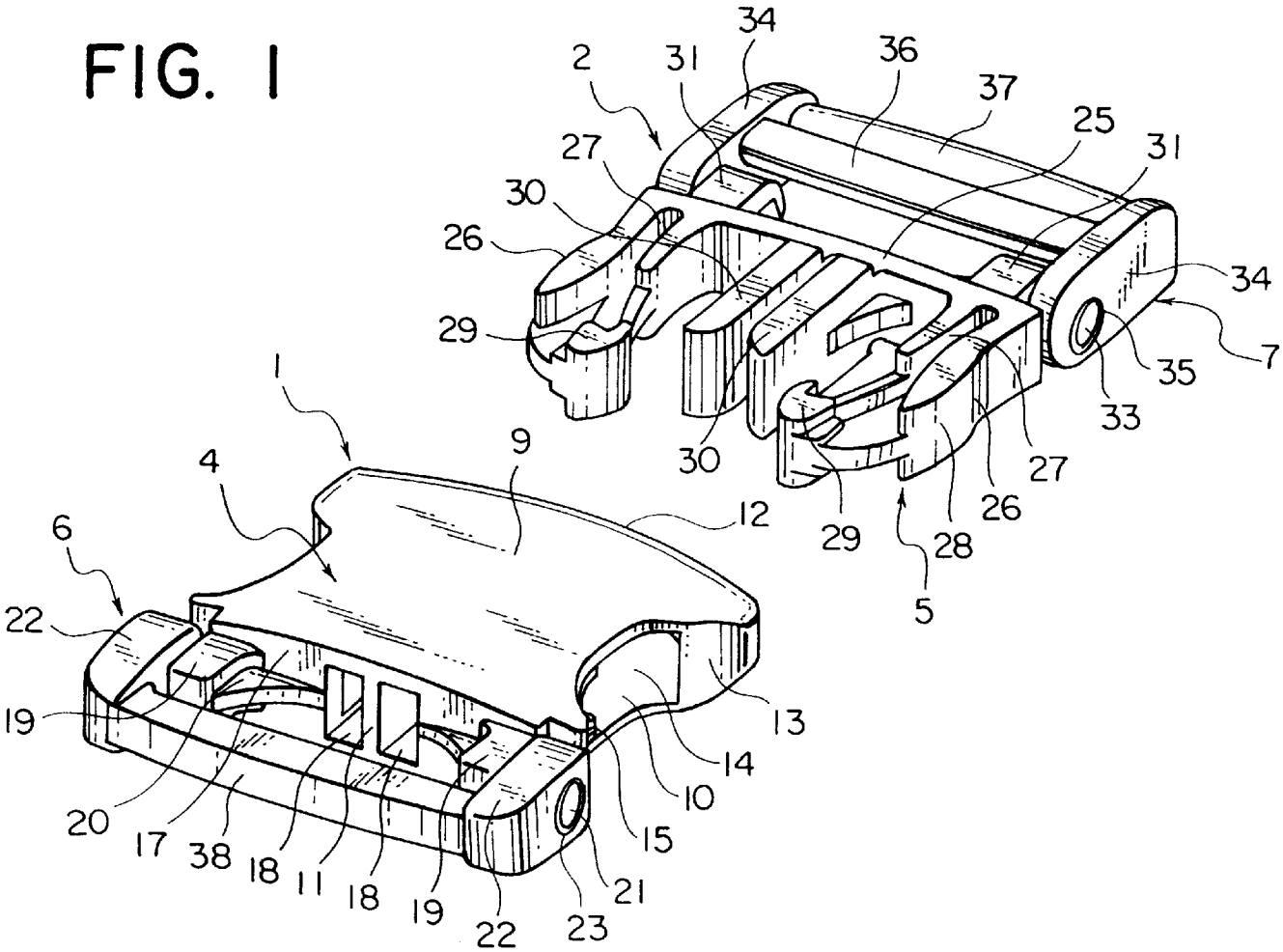
FIG. 1 is a perspective view of a female member and a male member of a buckle as being separated according to a first embodiment of the present invention.

In the buckle of the present invention, as shown in FIG. 1, a female member 1 comprises a housing 4 and a belt attaching frame 6 while a male member 2 comprises an insertion body 5 and a belt attaching frame 7. The insertion body 5 of the male member 2 is inserted into and engaged with the housing 4 of the female member 1. The housing 4 and the belt attaching frame 6 of the female member 1 and the insertion body 5 and the belt attaching frame 7 of the male member 2 are formed by injection molding or extrusion using such thermoplastic resin as polyamide, polyacetal, polypropylene, polybutylene terphthalate or any one of these resin containing wear resistance reinforcing agent.

Figure 2:
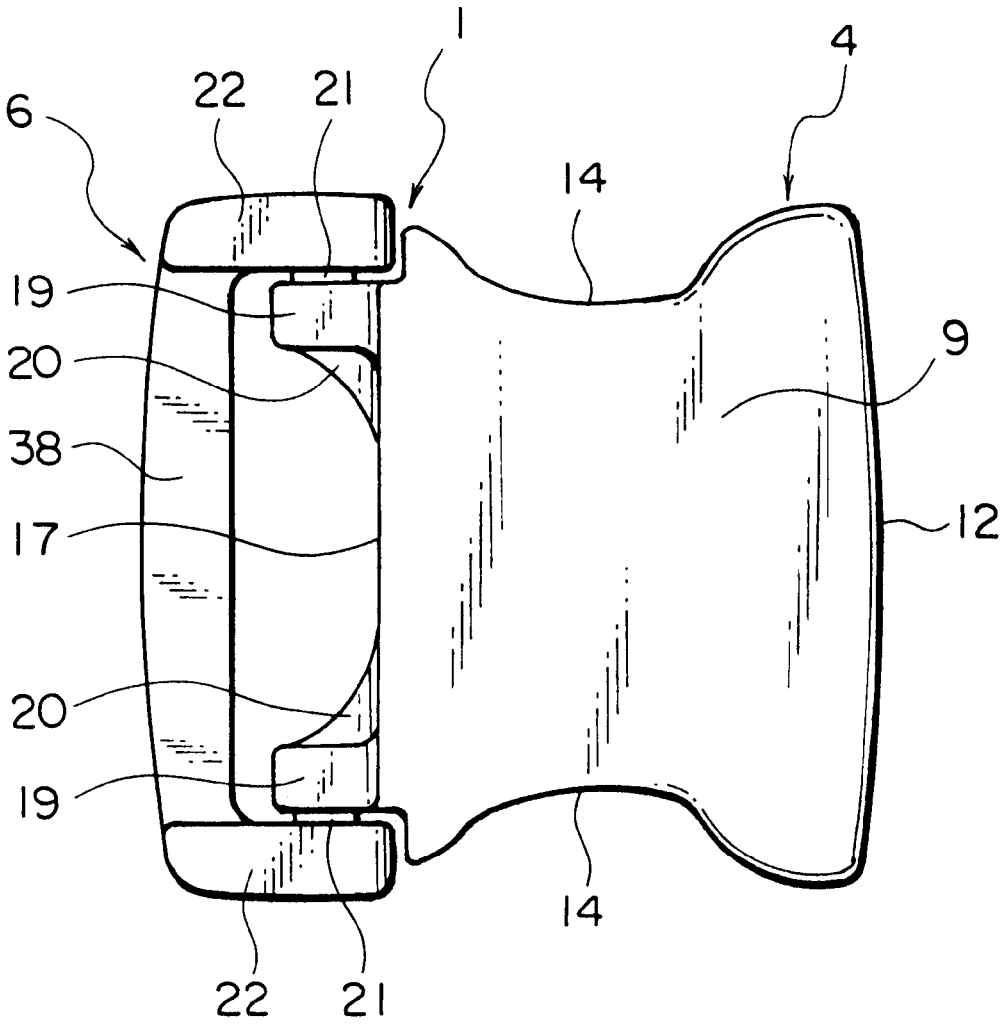
FIG. 2 is a front view of the female member of the same buckle.
Figure 3:
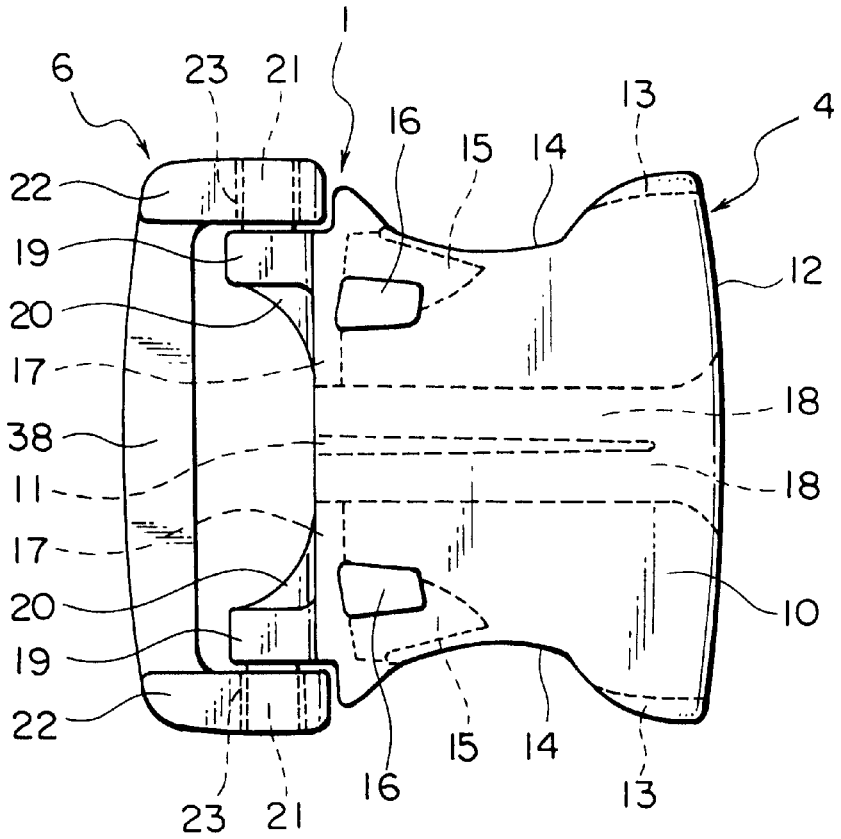
FIG. 3 is a rear view of the female member of the same buckle.
Figure 4:
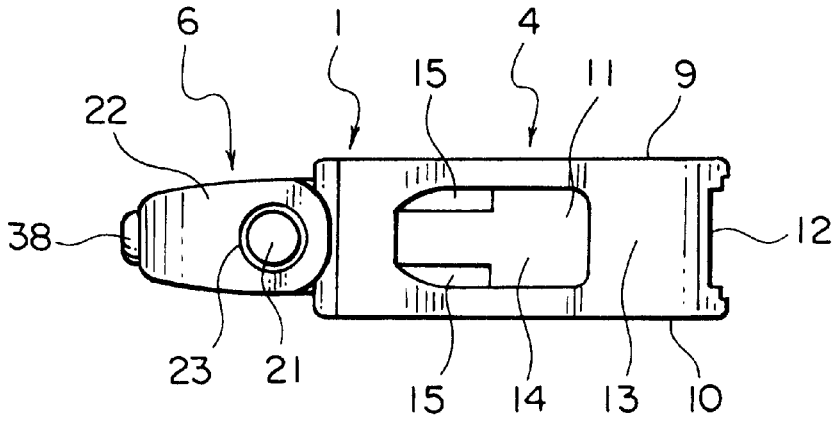
FIG. 4 is a side view of the female member of the same buckle.
Figure 5:
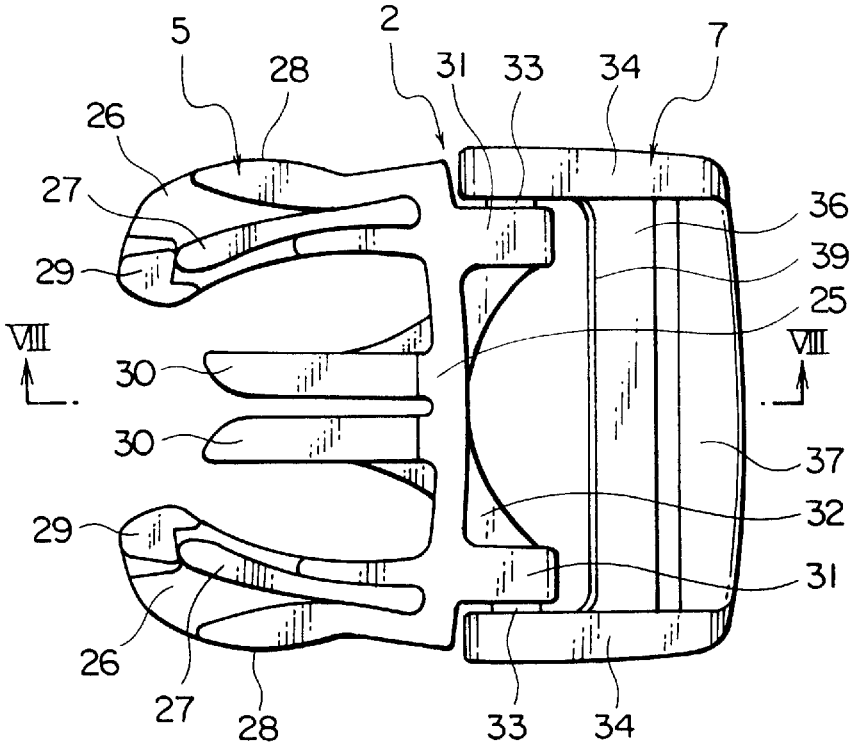
FIG. 5 is a front view of the male member of the same buckle.
Figure 6:
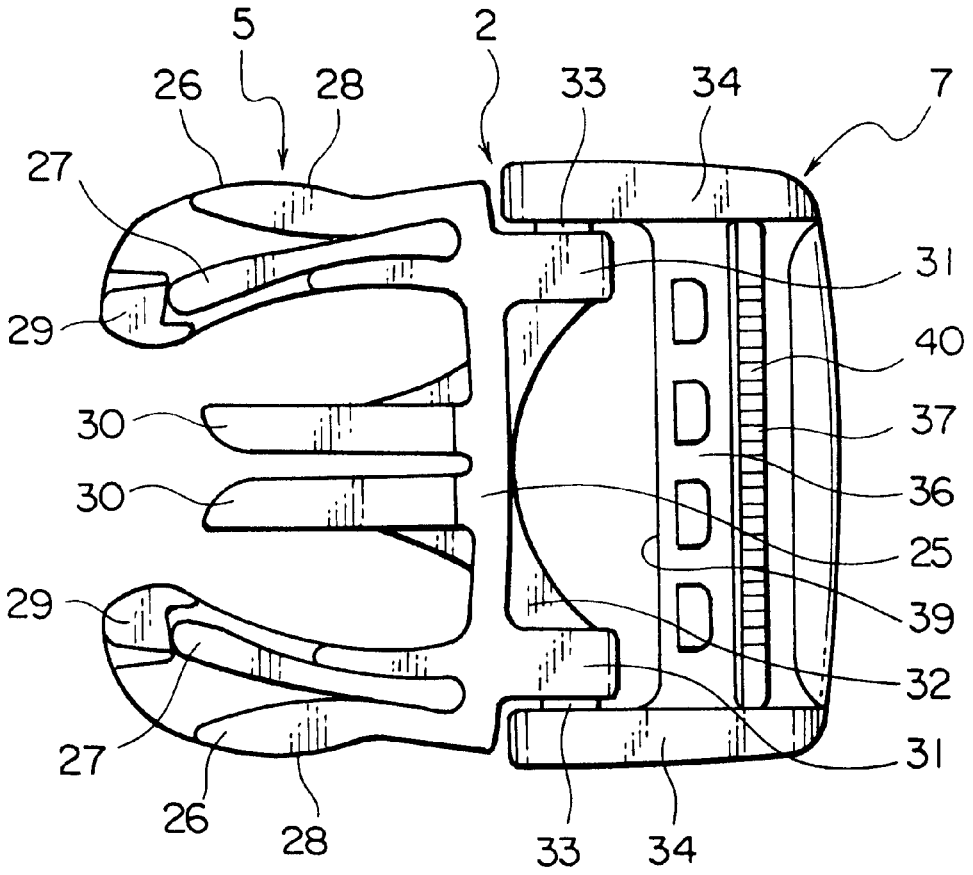
FIG. 6 is a rear view of the male member of the same buckle.
Figure 7:
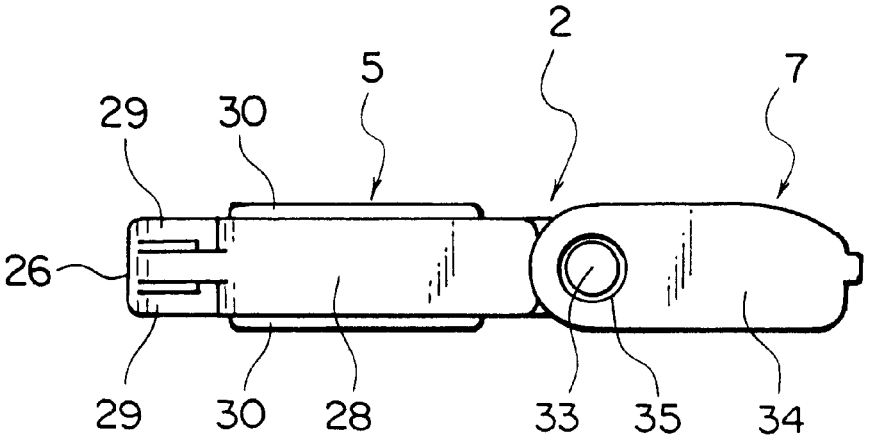
FIG. 7 is a side view of the male member of the same buckle.
Figure 8:
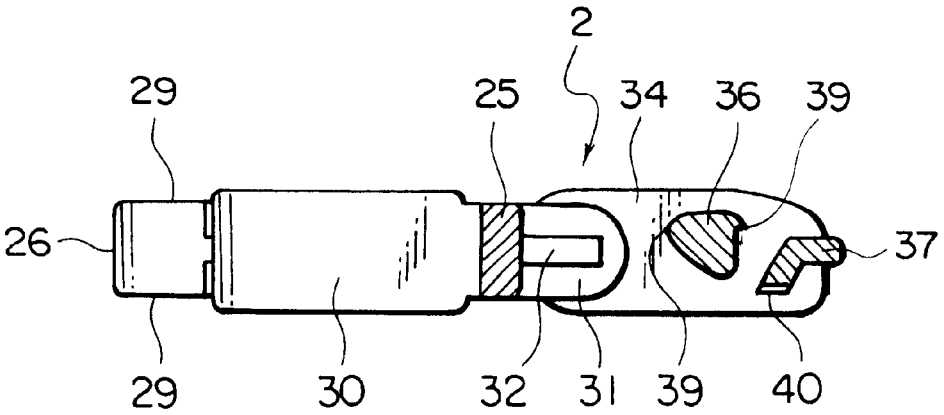
FIG. 8 is a sectional view taken along the line A—A in FIG. 5 of the male member of the same buckle.

The buckle according to a first embodiment shown in FIGS. 1 to 10 will be described. The female member 1 is a flat housing 4 comprising an upper plate 9, a bottom plate 10, side walls 13 and a front wall 17 as shown in FIGS. 2 to 4. An intermediate partition 11 is disposed at a center of each of the upper plate 9 and the bottom plate 10 extending in a length direction thereof to connect the upper plate 9 and the bottom plate 10. An end of the housing 4 and parts of the side walls 13 at both sides thereof are cut out, so that an insertion opening 12 at an opening on one end thereof, through which the insertion body 5 of the male member 2 is to be inserted. Further, part of each of the side walls 13 is cut out in a curved shape so as to form an opening 14.

When the male member 2 is inserted into the housing 4, insertion leg portions 26 of the male member 2 are exposed through the openings 14. If exposed pressing portions 28 of the insertion leg portions 26 are pressed, engaging protrusions 29 formed on top and bottom faces of front ends of the insertion leg portions 26 are disengaged from engaged portions 15 provided on inner faces of the top plate 9 and the bottom plate 10 of the housing 4 is released.

Guide grooves 18 for guiding a pair of guide pieces 30 provided on the insertion body 5 of the male member 2 are provided on both sides of the intermediate partition 11 provided on inner faces of the top plate 9 and bottom plate 10 of the housing 4 such that they are dented. The guide grooves 18 are formed penetrating the front wall 17 of the housing 4. Two core holes 16 are provided on the bottom plate 10 so as to form a pair of the engaged portions 15 to be provided on the inner faces of the top plate 9 and the bottom plate 10. The engaged portions 15 are formed in inward directed hook shapes, so that they correspond to hook-like engaging protrusions 29 provided at front ends of the insertion leg portions 26.

A pair of protruded pieces 19 are provided on a front end of the housing 4 or at both sides of the front wall 17 such that they are protruded forward. A shaft 21 is provided on an outer side face of each of the protruded pieces 19 such that it is protruded outward or in a lateral direction so as to support the belt attaching frame 6 rotatably. An oblique-shaped reinforcing portion 20 is disposed inside each of the pair of protruded pieces 19 so as to reinforce the protruded piece 19. On the other hand, the belt attaching frame 6 is constructed in an elongated U-shape and has an attaching member 38 on which a belt is to be attached, in a center thereof. Shaft holes 23 are provided at front ends of frame members 22 on both sides thereof so as to support the shafts 21. Consequently, the belt attaching frame 6 is freely rotatable relative to the housing 4.

The housing 4 and the belt attaching frame 6 are integrally formed in a connected state by disposing a cylindrical core in the connecting portion and injection molding or extrusion using thermoplastic resin. Consequently, the housing 4 and the belt attaching frame 6 are supported freely rotatably. It is permissible to mold the housing 4 and the belt attaching frame 6 separately while the shaft 21 are formed in the form of a small protrusion and the shaft holes 23 are formed to be concave so that both of them are press-fit such that the housing 4 and the belt attaching frame 6 are freely rotatable with respect to each other. This kind of the female member 1 is suitable for a small buckle on which no strong tension is applied.

As shown in FIGS. 5 to 8, the insertion body 5 of the male member 2 has a pair of insertion leg portions 26 which are provided at both sides thereof such that they are protruded forward. Each of the insertion leg portions 26 includes a hollow elongated hole portion 27 at a center so as to extend in a length direction thereof, so that they are elastically deformable easily on a plane. A center of an outside portion of the insertion leg portion 26 is curved sideway so as to form a pressing portion 28. When the insertion leg portions 26 are inserted into the housing 4, they are exposed through the openings 14 of the housing 4. A hook-like engaging protrusion 29, which is capable of engaging with the engaged portion 15 provided in the housing 4, is formed inside a front end of the insertion leg portion 26 such that it is protruded both top and bottom faces thereof. A pair of protruded guide pieces 30 are protruded from a center of the base member 25, so that they can receive the intermediate partition 11 provided in the housing 4 and slide in the guide grooves 18.

A pair of protruded pieces 31 are provided a both sides of the base member 25 of the insertion body 5 such that they are protruded opposite to the insertion leg portions 26. A shaft 33 is provided on an outer side face of each of the protruded pieces 31 such that it is protruded outward or laterally so as to support the belt attaching frame 7. An oblique-shaped reinforcing portion 32 is disposed inside each of a pair of the protruded pieces 31 so as to reinforce the protruded piece 31. On the other hand, the belt attaching frame 7 is formed generally in a U shape. A hooking frame 36 for hooking the belt is provided at an inner side of the belt attaching frames 7 while a holding frame 37 for holding the belt is provided at an outer side of the attaching frames 7, such that they are stretched between frame members 34 at both sides. Front and rear end portions of the hooking member 36 are formed to have sharp edge portions 39. A slippage-preventing uneven face 36 is formed on the bottom face of the holding member 34 so as to form a belt adjusting mechanism. Then, a shaft hole 35 is provided in a front end of each of the frame members 34 on both sides so as to support the shaft 33 provided on the protruded pieces 31 of the insertion body 5, so that the belt attaching frame 7 is freely rotatable with respect to the insertion body 5.

Like the molding of the housing 4 and the belt attaching frame 6 of the female member 1, the insertion body 5 and the belt attaching frame 7 are integrally molded using thermoplastic resin in a condition that the insertion body 5 and the belt attaching frame 7 are connected with a cylindrical core being disposed, so that the insertion body 5 and the belt attaching frame 7 are supported so as to be freely rotatable with respect to each other. Further, it is permissible to form the shaft 3 in the form of a small protrusion and the shaft hole 32 in a concave shape and to engage both the components by press-in such that they are easily movable. Consequently, the insertion body 5 and the belt attaching frame 7 are freely rotatable.

Figure 9:
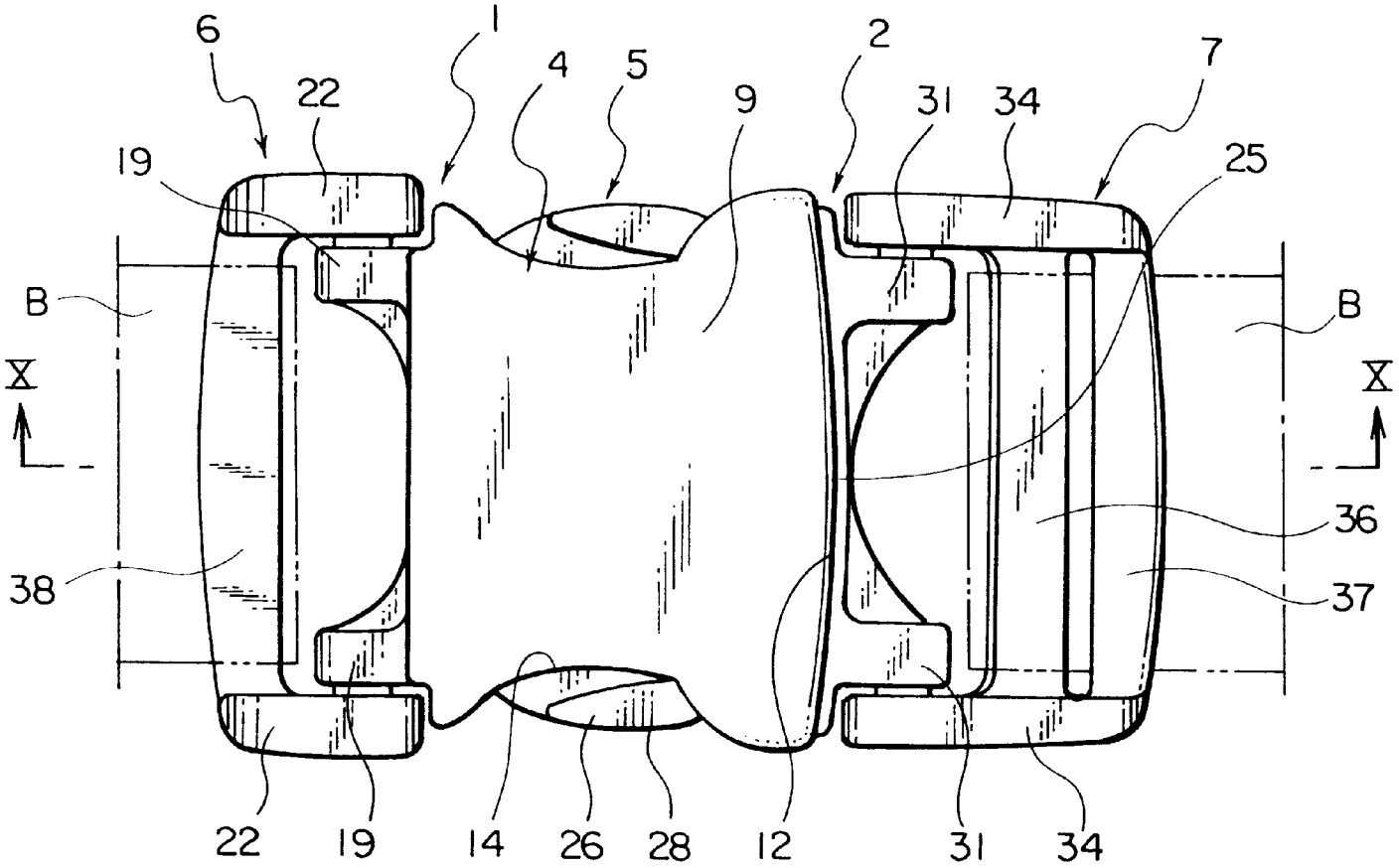
FIG. 9 is a front view the same buckle showing a use condition thereof.
Figure 10:
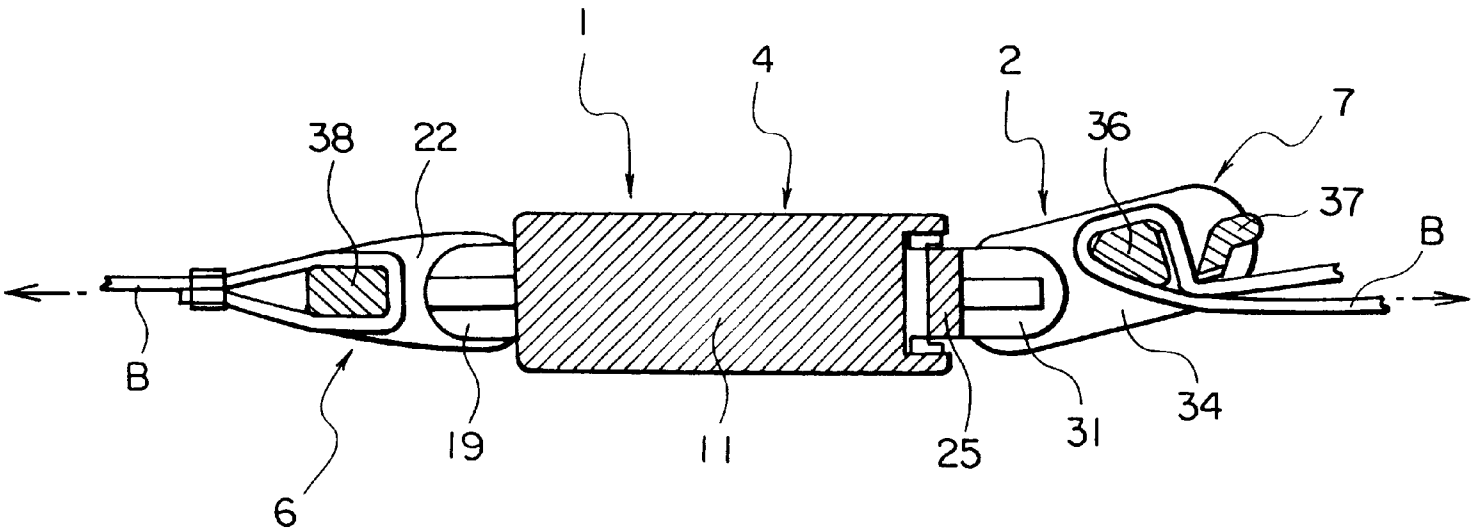
FIG. 10 is a sectional view taken along the line X—X in FIG. 9 in the use condition of the same buckle.

As for the use condition of the buckle, an end of the belt B is attached to the attaching member 38 of the belt attaching frame 6 of the female member 1 as shown in FIG. 9. The other end of the belt B is passed under the bottom face of the holding frame 37 and wound around the hooking frame 36 and then, passed between the holding frame 37 and the belt B which is placed previously, to be pulled outside. After that, the insertion body 5 of the male member 2 is inserted into the housing 4 of the female member 1 so that they engage each other. Then, the belt B is tightened firmly by pulling the belt B coming out of the belt attaching frame 7 of the male member 2. In this case, if the belt B is tightened, the belt attaching side of the belt attaching frame 7 is raised slightly as shown in FIG. 10.

Figure 11:
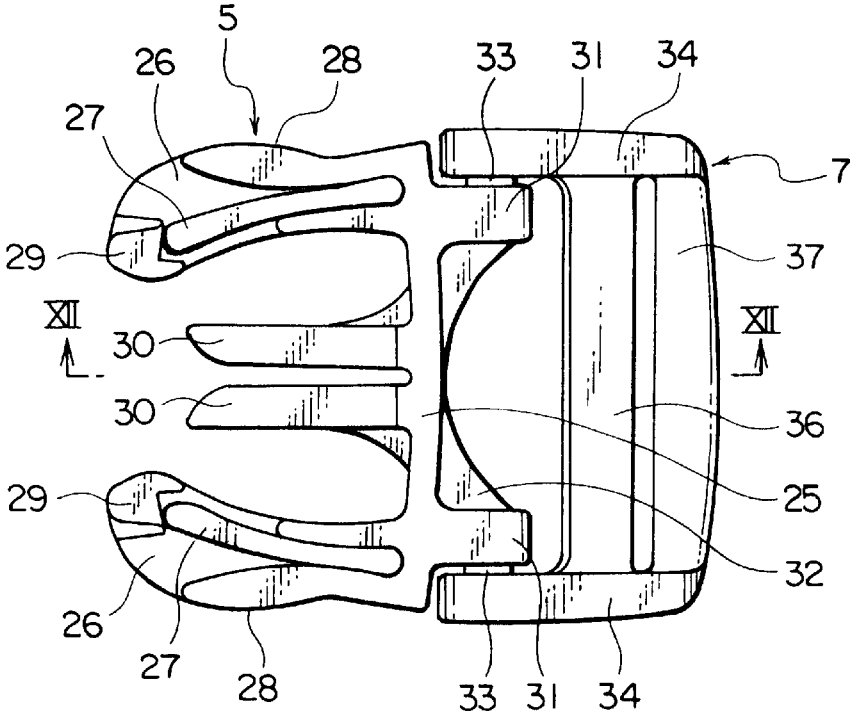
FIG. 11 is a front view of the male member showing a modification of a belt attaching frame having a length adjusting mechanism.
Figure 12:
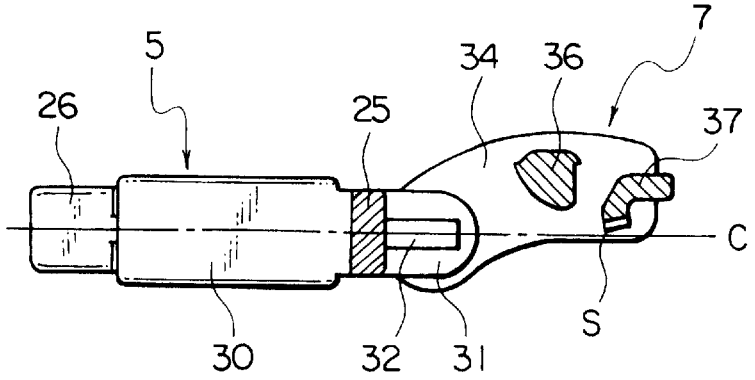
FIG. 12 is a sectional view taken along the line XII—XII in FIG. 11 of the same belt attaching frame.
Figure 13:
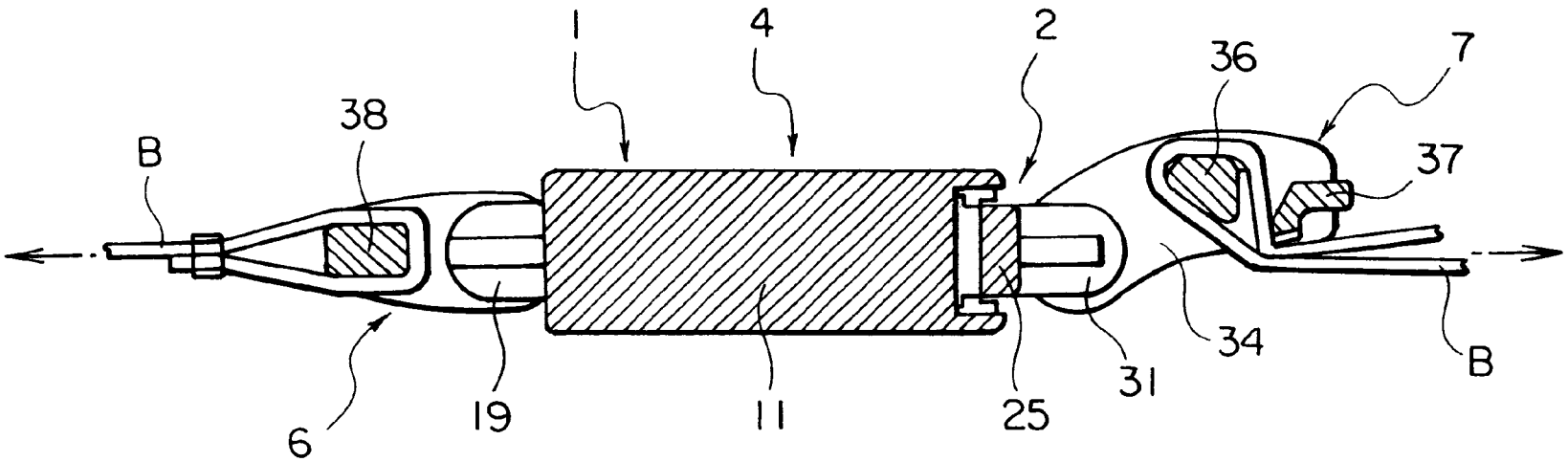
FIG. 13 is a sectional view corresponding to FIG. 10, indicating a use condition when the belt is attached to the same belt attaching frame.

As shown in FIGS. 11 and 12, the frame member 34 of the belt attaching frame 7 is so formed that its intermediate portion is curved upward from the shaft hole 35. The hooking frame 36 for hooking the belt and the holding frame 37 for holding the belt are formed between the frame members 34 such that they are deflected upward of a center line C of tensile load on the belt B while a holding action point S on the holding member 37 exists on the center line C of the tensile load. If the belt B is attached and pulled to be tightened, the belt and the attaching frame 7 can hold the belt B accurately with a good appearance while preventing an excessive rise as shown in FIG. 13.

Figure 14:
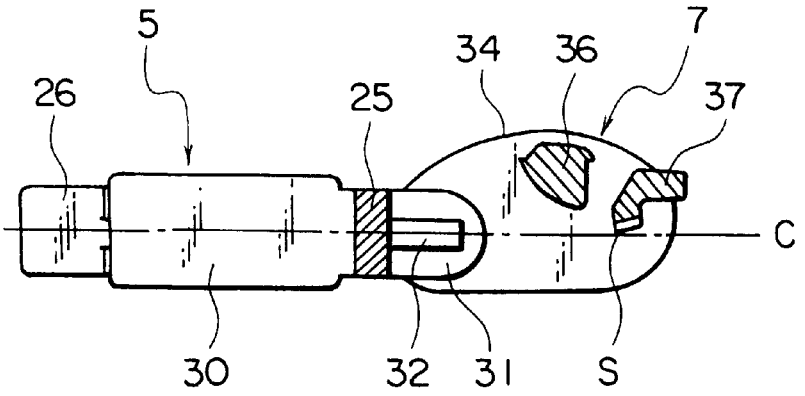
FIG. 14 is a sectional view corresponding to FIG. 12 showing another modification of the same belt attaching frame.

Instead of forming the frame member 34 of the belt attaching frame 7 such that its side view is curved, it is permissible to form the frame member 34 that the side view is substantially an egg shape while the bottom line is straight as shown in FIG. 14. Consequently, the bottom face of the frame member 34 can be in contact with the surface of a product to be used. Thus, the belt attaching frame 7 is capable of tightening the belt in a stable condition.

Figure 15:
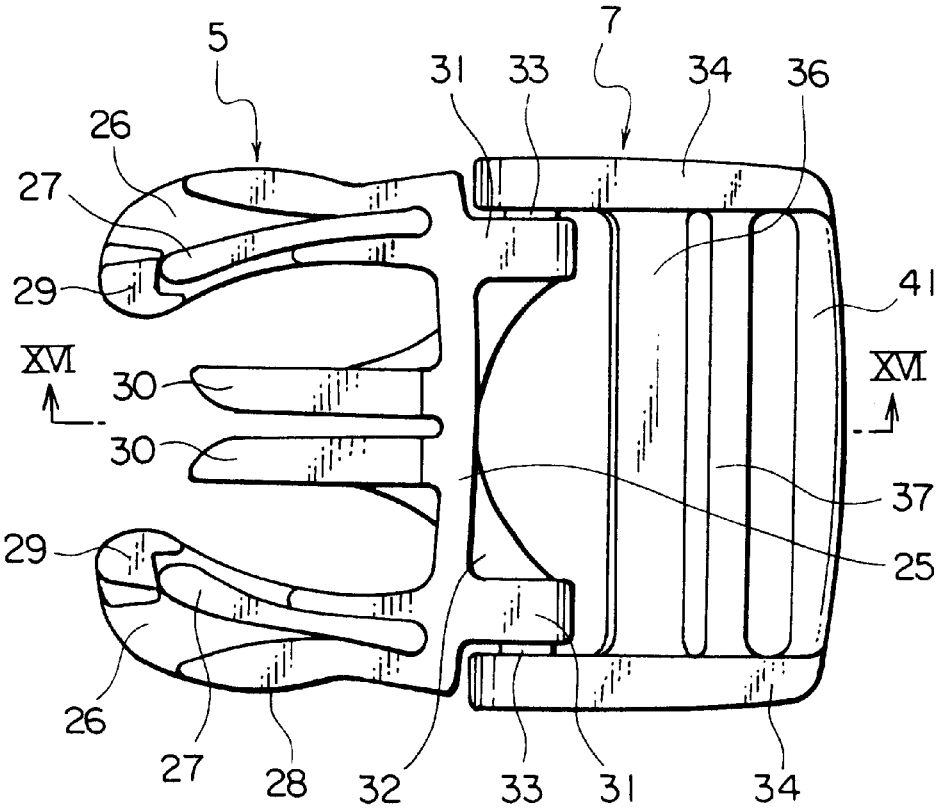
FIG. 15 is a front view of the male member showing still another modification of the same belt attaching frame.
Figure 16:
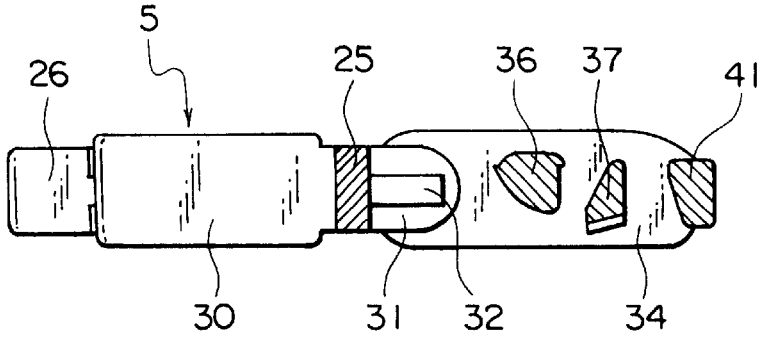
FIG. 16 is a sectional view taken along line XVI—XVI in FIG. 15 of the same belt attaching frame.

Further, as shown in FIGS. 15 and 16, the frame member 34 of the belt attaching frame 7 is formed such that its side view is straight. The hooking member 36 for hooking the belt and the holding member 37 for holding the belt are disposed from an inner side of the frame member 34 to the outer side. Further, a blocking member 41 for blocking a rise of the belt attaching frame 7 is provided at a further outside thereof. Then the belt attaching frame 7 is completed. The belt B is passed over the blocking member 41 and then passed below the holding member 37. The belt B is then wound around the hooking member 36 from below and is passed between the previously introduced belt B and the holding member 37 below the holding member 37 and then discharged above the blocking member 41. If the belt B is tightened, the blocking member 41 of the belt attaching frame 7 is pressed downward by tensile load of the belt B so as to prevent the belt attaching frame 7 from being raised. Thus, it is possible to firmly tighten the belt B in a stable condition while the housing 4 and the belt attaching frame 6, or the insertion body 5 and the belt attaching frame 7 are freely rotatable with respect to each other so as to fit the configuration of the surface of the product.

In order to release the tightening of the belt B, the pressing portion 28 of the insertion leg portion 26 exposed through the opening 14 in the housing 4 of the female member 1 is pressed so as to retreat the insertion leg portion 26 into the housing 4. By releasing the engagement between the engaging portion 15 and the fitting protrusion 29, the belt B can be loosened easily.

Meanwhile, the belts to be used for the female member 1 and the male member 2 may be independent. The length of the belt can be adjusted for use by fixing an end of one belt to the product while the other end thereof to the attaching member 38 of the belt attaching frame 6 of the female member 1 while fixing one end of the other belt to the product and passing the other end thereof into the belt adjusting mechanism of the hooking member 36 and the holding member 37 of the belt attaching frame 7 of the male member 2.

(Second Embodiment)

Figure 17:
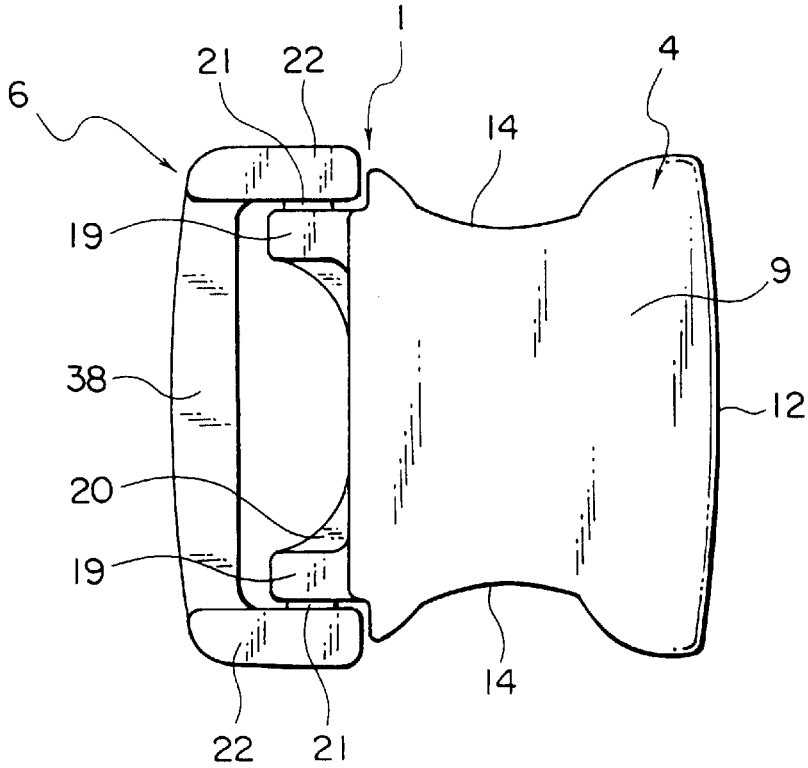
FIG. 17 is a front view of a female member in a buckle according to a second embodiment of the present invention.
Figure 18:
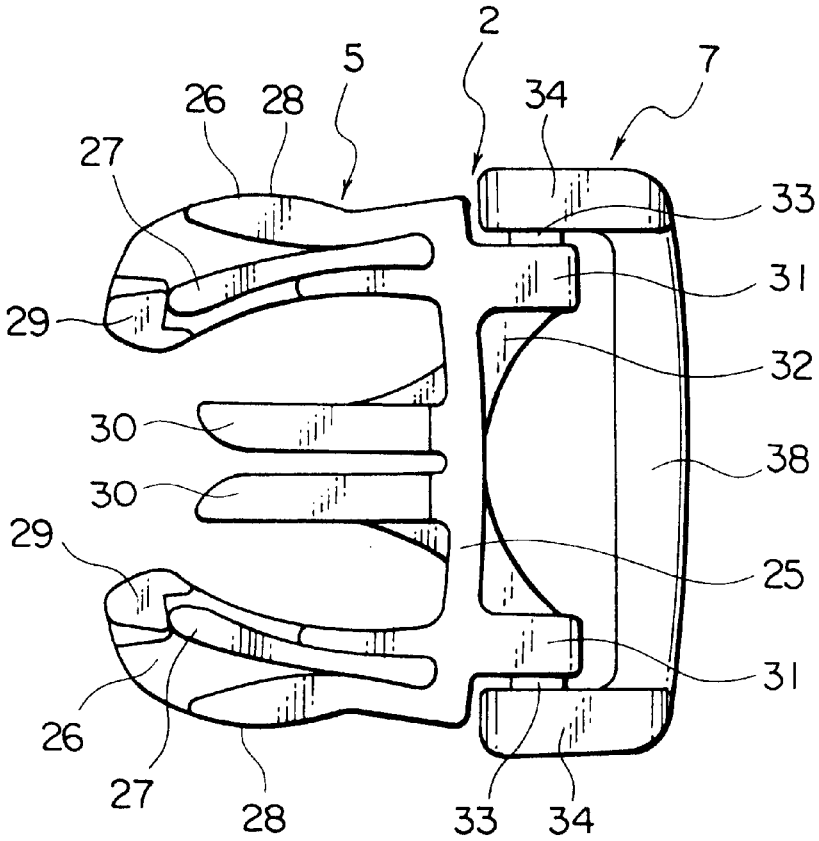
FIG. 18 is a front view of a male member of the same buckle.
Figure 19:
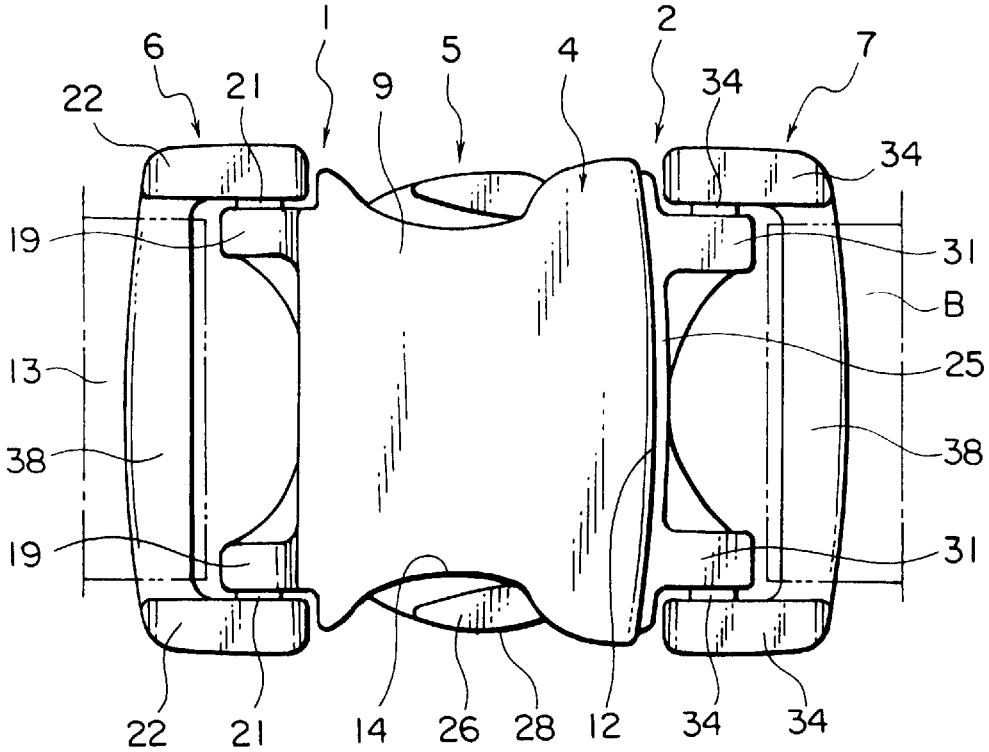
FIG. 19 is a front view showing a use condition of the same buckle.

A buckle of a second embodiment shown in FIGS. 17 to 19 will be described. A female member 1 of the buckle has the same structure as that of the buckle of the first embodiment. A belt attaching frame 6 having an attaching member 38 for attaching the belt is attached to a pair of protruded pieces 19 provided at both sides of the housing 4 such that it is freely rotatable. Although the male member 2 has the same configuration as the insertion body 5 of the buckle of the first embodiment, the configuration of the belt attaching frame 7 to be attached to the insertion body 5 is different. The attaching member 38 for attaching the belt is disposed between front ends of the frame members 34 provided at both sides of the belt attaching frame 7. This buckle is produced by integrally molding by injection molding or extrusion using thermoplastic resin like the first embodiment.

As for use condition of the buckle, the belt attaching frames 6, 7 provided on the female member 1 and the male member 2 have only the attaching member 38 for attaching the belt. This type of the buckle is employed at an attachment position, which does not necessitate adjustment of the length of the belt. For example, as shown in FIG. 19, two belts B are fixed to a product to be used. The belt attaching frame 6 of the female member 1 and the belt attaching frame 7 of the male member 2 are attached to the respective end portions of the belts B. After a bag for a small article, a portable product and the like is hung from one belt B, the insertion body 5 of the male member 2 is inserted in and engaged with the housing 4 of the female member 1. This buckle is used for hanging a small bag from a large-size carrier bag. Therefore, because the buckle does not necessitate adjustment of the belt and the belt attaching frames 6, 7 provided on the buckle can rotate freely, the buckle can be formed in a small size and handled easily.

(Third Embodiment)

Figure 20:
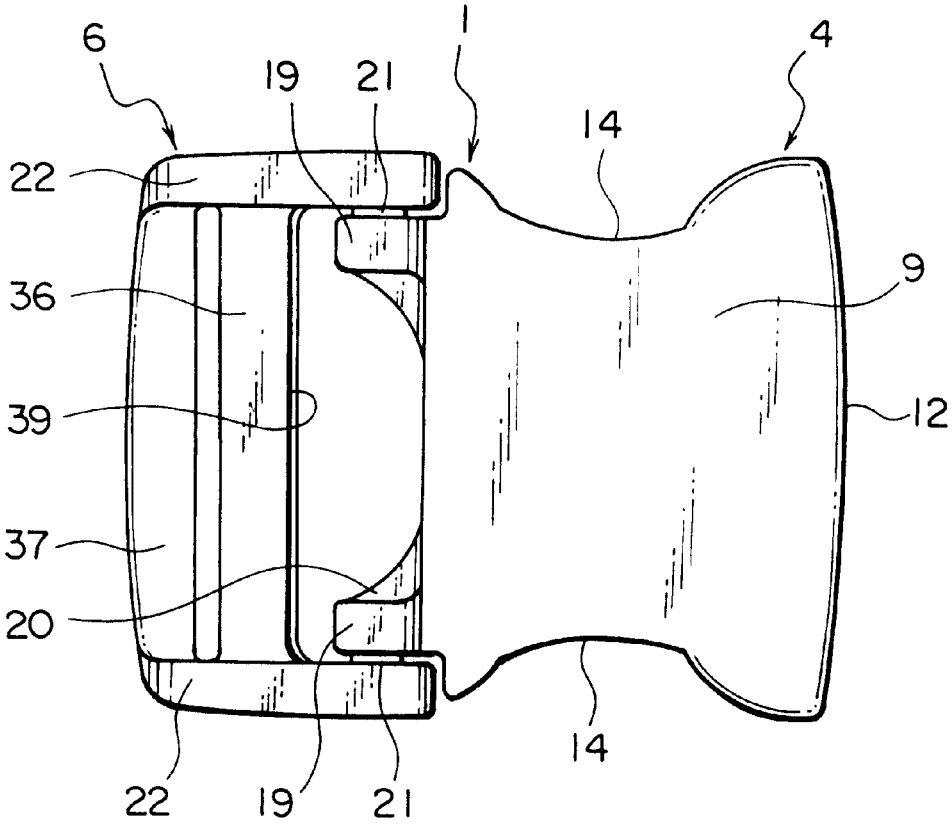
FIG. 20 is a front view of a female member in a buckle according to a third embodiment of the present invention.
Figure 21:
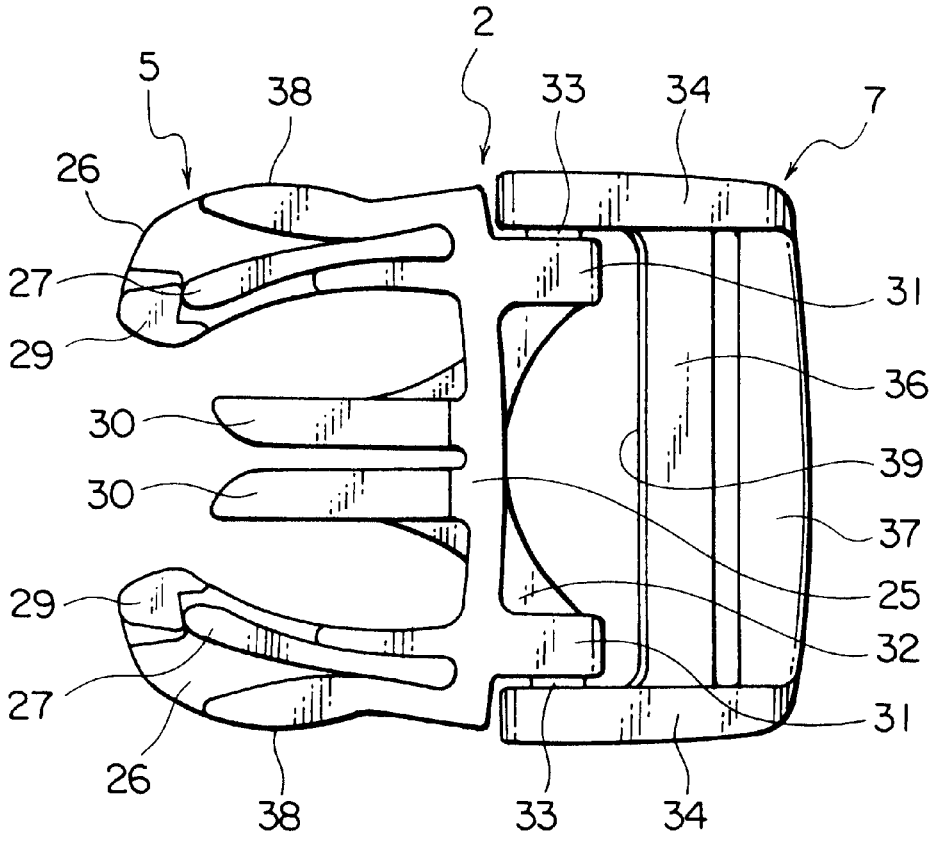
FIG. 21 is a front view of a male member in the same buckle.
Figure 22:
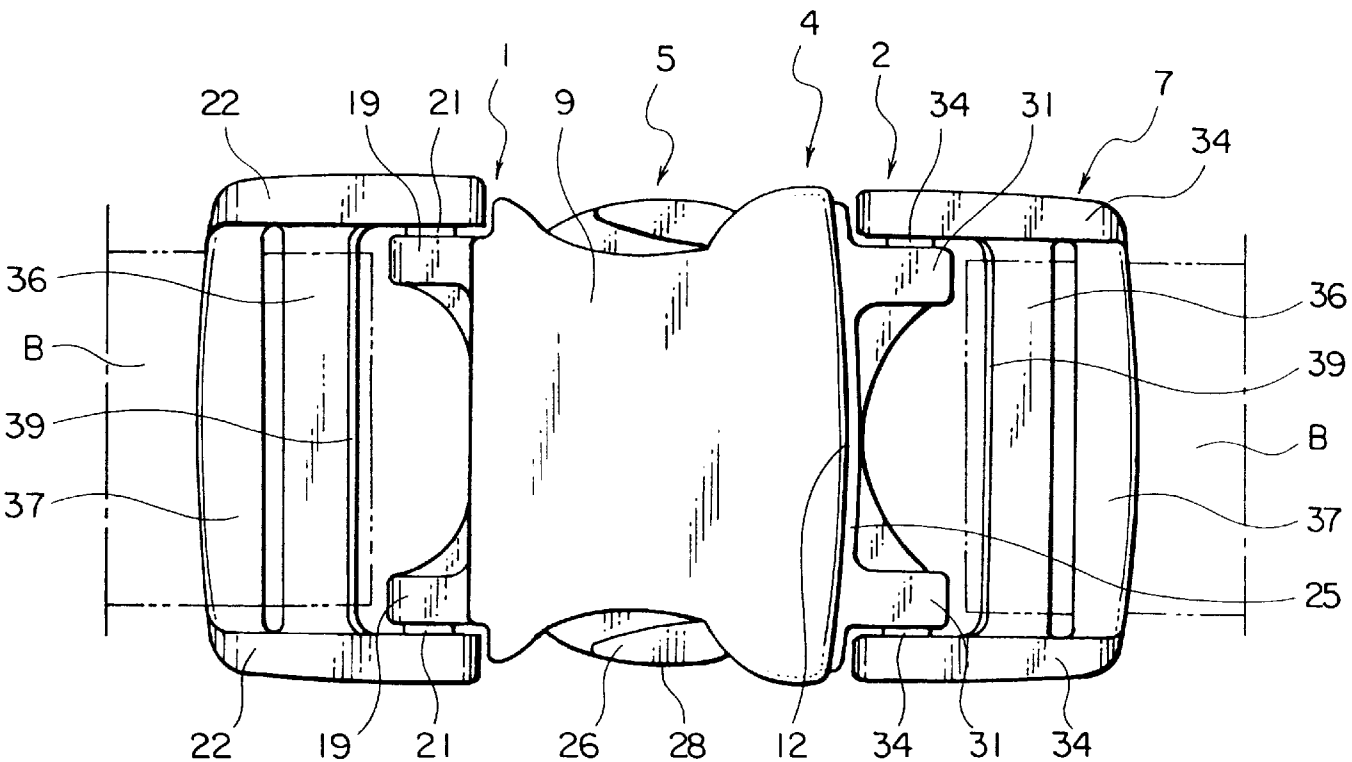
FIG. 22 is a front view showing a use condition of the same buckle.
Figure 23:
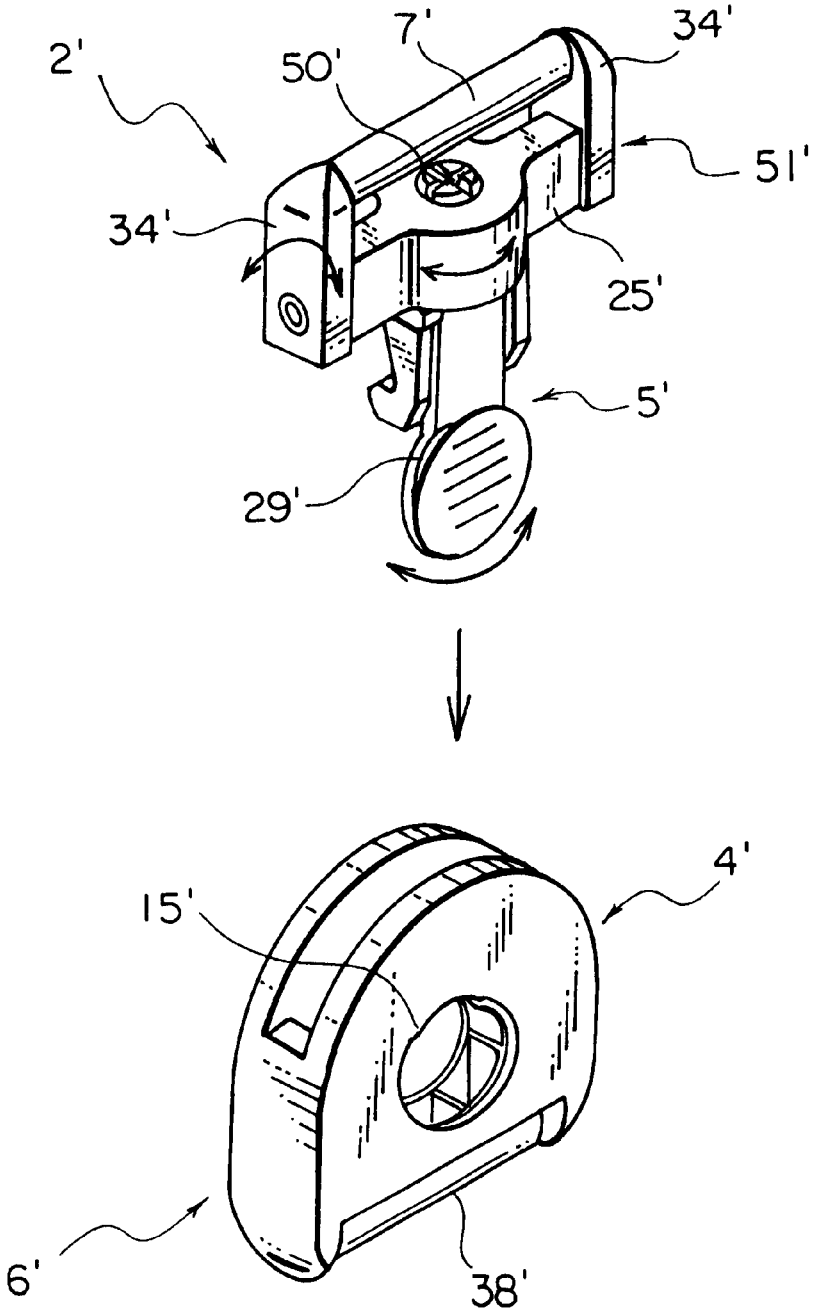
FIG. 23 PRIOR ART
FIG. 23 is a perspective view of a well-known insertion type buckle.
Figure 24:
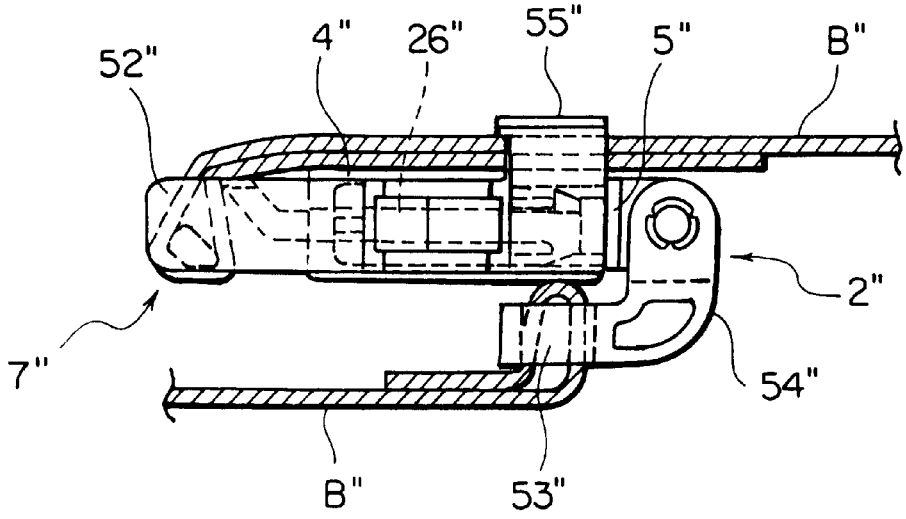
FIG. 24 PRIOR ART
FIG. 24 is an explanatory diagram showing an engaged state of another well-known insertion type buckle.

Finally, the buckle of the third embodiment shown in FIGS. 20 to 22 will be described. The male member 2 has the same configuration as that of the buckle of the first embodiment. A belt attaching frame 7, which contains a hooking member 36 at an inner side thereof for hooking a belt and a holding member 37 at an outer side thereof for holding the belt, is attached to a pair of protruded pieces 31 provided at both sides of the base member 25 of the insertion body 5 such that it is freely rotatable. Although the female member 1 has the same structure as the housing 4 of the buckle of the first embodiment, the structure of the belt attaching frame 6 to be attached to this housing 4 is different. The hooking member 36 for hooking the belt at the inner side and the holding member 37 for holding the belt at the outer side are disposed between the frame members 22 at both sides of the belt attaching frame 6, so that the length of the belt can be adjusted. This buckle is produced by injection molding or extrusion using thermoplastic resin like the first embodiment.

As for the use condition of the buckle, each of the belt attaching frames 6, 7 attached to the female member 1 or the male member 2 so as to be freely rotatable includes the hooking member 36 for hooking the belt and the holding member 37 for holding the belt. When this type of the buckle is attached to a product to be used, the length of the belt can be adjusted at the either side or either one of the belt attaching frames 6, 7 provided on the female member 1 and the male member 2 freely.

The buckle of the present invention has the above-described structure and the following effects can be exerted with this structure.

In the buckle of an insertion, the male member 2 is comprised of an insertion body 5 and a belt attaching frame 7, which are formed separately, and the insertion body 5 and the belt attaching frame 7 are linked with each other so as to be freely rotatable, while the female member 1 is comprised of a housing 4 and a belt attaching frame 6, which are formed separately, and the housing 4 and the belt attaching frame 6 are linked with each other so as to be freely rotatable. Consequently, in the buckle of this type in which the male member 2 is inserted into the female member 1, the belt attaching frames 6, 7 disposed at both sides of the buckle can be rotated freely with respect to the housing 4 of the female member 1 and the insertion body 5 of the male member 2. Therefore, this buckle can readily fit the configuration of the surface of a product to be used, particularly its curved shape, so that the fastening operation can be carried out easily and securely with a good appearance and stable tightening can be executed.

Further, the male member 2 has protruded pieces 31 protruded from both sides of the base member 25 of the insertion body 5 in an opposite direction to the insertion leg portions 26 while shafts 33 are provided so as to protrude on outer faces of the protruded pieces 31 and the frame members at front ends of both sides of the belt attaching frame 7 have shaft holes 35 which allow the shafts 33 to be pivoted by being loosely received therein. Consequently, the belt attaching frame 7 of the male member 2 can be attached easily and securely to the insertion body 5, and further the belt attaching frame 7 can be rotated by a smooth rotating operation.

Furthermore, the female member 1 has protruded pieces 19 protruded from front ends of both sides of the housing 4 opposite to the insertion opening of the housing 4, shafts 21 are provided so as to protrude on outer faces of the protruded pieces 19 while shaft holes 23, which the shafts 21 are capable of engaging such that they are freely movable, are provided at front ends of the frame members 22 at both sides of the U-shaped belt attaching frame 6. Consequently, the belt attaching frame 6 can be attached to the housing 4 easily and securely and further, the belt attaching frame 6 can be rotated by a smooth rotating operation.

Still further, the insertion body 5 and the belt attaching frame 7 of the male member 2, and the housing 4 and the belt attaching frame 6 of the female member 1 are formed by integral molding using synthetic resin. Consequently, the male member 1 and the female member 2 of the buckle can be produced easily.

One of the belt attaching frames 7, 6 disposed in the male member 2 and the female member 1 has a hooking member 36 for hooking the belt B and a holding member 37 for holding the belt B, which are provided in parallel to each other while the other of the belt attaching frames 7, 6 has an attaching member 38 for attaching the belt B. Alternatively, both the belt attaching frames 7, 6 disposed in the male member 2 and the female member 1 may have only attaching members 38 for attaching the belt B, or both the belt attaching frames 7, 6 disposed in the male member 2 and the female member 1 have a hooking member 36 for hooking the belt B and a holding member 37 for holding the belt B, which are disposed in parallel. Consequently, the following effects are produced.

The shape of the buckle of the insertion type that can be adapted to a product to be used may include an enlarged one, miniature one, the one in which the belt is fixed to the both members, or the one in which the length of the belt is adjustable at both the members. Therefore, the tightening operation of the buckle can be carried out smoothly, so that the user's demand can be met quickly.

Still further, the hooking member 36 for hooking the belt B and the holding member 37 for holding the belt B, which are disposed between he belt attaching frames 6, 7, are disposed between the frames 6, 7 such that they are deflected upward of a center line of tensile load while a holding action point exists on the tensile line. Alternatively, the blocking member 41 for blocking a rise of the belt attaching frames 6, 7 may be provided on an outer side of the hooking member 36 for hooking the belt B and the holding member 37 for holding the belt B. Consequently, even if the belt length adjusting mechanism is provided, the adjusting mechanism is never raised from the surface of the product when the belt B is tightened due to the tensile load of the belt B. Thus, the belt B can be tightened securely with a stable condition and a good appearance.

REFERENCE NUMERALS

1: Female member
2: Male member
4: Housing
5: Insertion body
6: Belt attaching frame (female member)
7: Belt attaching frame (male member)
12: Insertion opening
19: Protruded piece (female member)
21: Shaft (female member)
22: Frame member (female member)
23: Shaft hole (female member)
25: Base member
26: Insertion leg portion
31: Protruded piece (male member)
33: Shaft (male member)
34: Frame member (male member)
35: Shaft hole (male member)
36: Hooking member
37: Holding member
38: Attaching member
41: Blocking member
C: Centerline of tensile load
S: holding action point

What is claimed is:

1. A buckle of a type in which an insertion body of a male member is inserted into a housing of a female member, wherein the male member is comprised of the insertion body and a belt attaching frame having a U shape, the insertion body and the belt attaching frame being formed separately while the insertion body and the belt attaching frame are linked with each other so as to be freely rotatable, and the female member is comprised of the housing and a belt attaching frame having a U shape, the housing and the belt attaching frame being formed separately while the housing and the belt attaching frame are linked with each other so as to be freely rotatable, wherein the female member has protruded pieces protruded outward at both sides of a front end of the housing opposite to an insertion opening thereof, shafts are provided so as to protrude on outer faces of the protruded pieces, and shaft holes, which the shafts are capable of engaging so as to be freely movable, are provided at front ends of frame members at both sides of the belt attaching frame of the female member so that the shafts are pivotally supported by the shaft holes.

2. The buckle according to claim 1, wherein the male member has protruded pieces protruded from both sides of a base member of the insertion body in a direction opposite to insertion leg portions, shafts are provided so as to protrude on outer faces of the protruded pieces, shaft holes, which the shafts are capable of engaging so as to be freely movable, are provided at front ends of frame members at both sides of the belt attaching frame of the male member so that the shafts are pivotally supported by the shaft holes.

3. The buckle according to claim 1, wherein a hooking member for hooking a belt and a holding member for holding a belt, which are disposed on the belt attaching frames, are disposed between frame members such that the hooking member and the holding member are deflected upward of a center line of tensile load while a holding action point exists on the line.

4. The buckle according to claim 1, wherein a blocking member for blocking a rise of the belt attaching frames is provided between the frame members on an outer side of a hooking member for hooking a belt and a holding member for holding a belt disposed at the belt attaching frames.

5. The buckle according to claim 1, wherein one of the belt attaching frames disposed in the male member and the female member has a hooking member for hooking a belt and a holding member for holding a belt, which are provided in parallel to each other, while the other one of the attaching frames has an attaching member for attaching a belt.

6. The buckle according to claim 1, wherein both of the belt attaching frames disposed in the male member and the female member have attaching members for attaching belts.

7. The buckle according to claim 1, wherein both of the belt attaching frames disposed in the male member and the female member have hooking members for hooking belts and holding members for holding belts.

* * * * *